United States Patent [19]

Alexander

[11] Patent Number: 5,016,452

[45] Date of Patent: May 21, 1991

[54] METHOD OF TRANSFERRING PHOTOGRAPHS TO LEATHER

[76] Inventor: Ronald Alexander, 463 Classon Ave., Brooklyn, N.Y. 11238

[21] Appl. No.: 427,434

[22] Filed: Oct. 27, 1989

[51] Int. Cl.[5] ..... C14B 1/56

[52] U.S. Cl. ..... 69/21; 69/2; 434/88; 434/81

[58] Field of Search ..... 69/2, 21; 434/81, 82, 434/84, 87, 88, 95

[56] References Cited

U.S. PATENT DOCUMENTS

| | | | |
|---|---|---|---|
| 1,993,523 | 3/1935 | Poschel | 41/33 |
| 2,002,792 | 5/1935 | Sart | 41/24 |
| 2,130,222 | 9/1938 | Barrett | 41/24 |
| 3,930,921 | 1/1976 | Connett | 156/234 |
| 4,328,051 | 5/1982 | Robinette | 434/84 |
| 4,640,529 | 2/1987 | Katz | 112/439 |

*Primary Examiner*—Werner H. Schroeder
*Assistant Examiner*—Michael A. Neas
*Attorney, Agent, or Firm*—Henderson & Sturm

[57] ABSTRACT

A method of replicating a color photograph (11) onto a leather surface by transferring the photograph (11) to a xerographic copy (20), tracing the copy (20) onto the surface of the leather (50), using specialized leather working tools (30) to cut and raise the surface of the leather (50) and then applying colored leather dyes (81) to selected portions of the leather surface in accordance with the color scheme of the color photograph (11).

9 Claims, 2 Drawing Sheets

METHOD OF TRANSFERRING PHOTOGRAPHS TO LEATHER

TECHNICAL FIELD

The present invention relates generally to methods of transferring images from one medium to another, and more particularly to a method transferring a photographic image onto a leather surface.

BACKGROUND OF THE INVENTION

This invention was the subject matter of Document Disclosure Program Registration No. 191931 which was filed in the U.S. Patent and Trademark Office on Apr. 29, 1988.

As can be seen by reference to the following U.S. Pat. Nos.: 2,002,792; 1,993,523; 2,130,222 and 3,930,921 the prior art is replete with myriad and diverse methods for adorning leather with ornamentation and designs.

While all of the aforementioned prior art methods are more than adequate for the basic purpose and limited functions that they serve, these previously patented processes fall far short of producing an individualized replication of a photographic image on the surface of leather.

To date no one has developed a relatively simple and straightforward process for accomplishing that goal, and the provision of such a method is a stated objective of the present invention.

SUMMARY OF THE INVENTION

Briefly stated, the present invention involves a series of method steps that if followed will allow anyone to transfer a three dimensional replication of a photographic image onto the surface of leather.

The steps involved in the process begin with the selection of a photograph that the individual wishes to replicate onto the leather surface. Then a xerographic image of the photograph is produced. This xerographic image is then taped onto the premoistened surface of the leather at a desired location.

At this juncture the photostatic image is traced onto the leather surface and the photostatic image is then subsequently removed from the leather surface; whereupon, a cutting tool is used to cut along the traced lines on the leather. Then the leather surface is remoistened and raised in selected areas using a leather working tool.

Once these steps have been completed and the leather has been allowed to dry the leather surface is coated with a leather softening mixture preparatory to the dying process. After the leather has been prepped, the original photograph is again used to select the dyes that will be applied to the leather surface in accordance with the color scheme of the photograph; and, when the dyes dry the surface is coated with a liquid polish.

BRIEF DESCRIPTION OF THE DRAWINGS

These and other objects, advantages and novel features of the invention will become apparent from the detailed description of the best mode for carrying out the preferred embodiment of the invention which follows; particularly when considered in conjunction with the accompanying drawings, wherein.

BEST MODE FOR CARRYING OUT THE INVENTION

Figure 1:
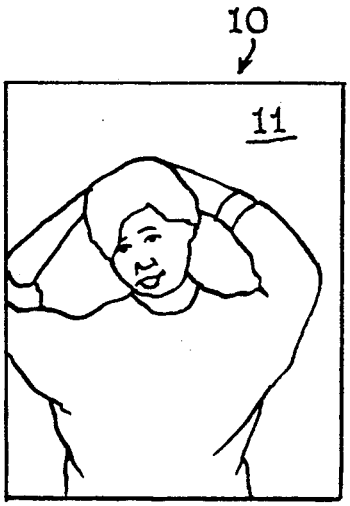
FIG. 1 is a representative photograph to be employed in conjunction with this method.

As can be seen by reference to the drawings the method that forms the basis of this invention involves the replication of a photographic image (10) onto an undyed leather surface (50).

The method of this invention begins with the selection of a desired photographic image (10) from a color photograph (11) or the like. The photographic image (10) is then transferred to a photostatic or xerographic copy (20) formed on a sheet of relatively lightweight paper (21).

At this point the undesired image portion (22) of the xerographic copy (20) is trimmed away using a conventional cutting implement (60) such as a scissors (61) or a knife (62). The sheet (51) of leather (50) is then premoistened with a liquid applicator such as a sponge dipped into a water bearing receptacle and, the trimmed xerographic image (20) is positioned at a desired location on the leather surface (50).

At this juncture it should be noted that the stationary positioning of the xerographic image (20) on the leather surface can be accomplished by several alternative method steps such as pinning or taping the xerographic copy (20) to position the paper (21) in a generally flat stationary position relative to the leather surface (50).

Figure 2:
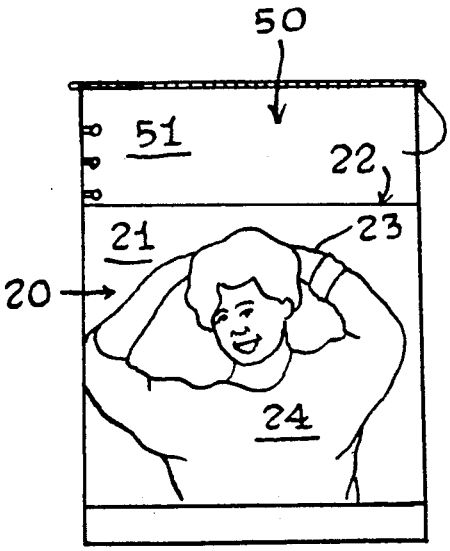
FIG. 2 is a perspective view of the photostatic image and sheet of leather with the equipment used in the initial steps of the method.

Once the xerographic image (20) has been satisfactorily positioned, a tracing implement (40) such as a pencil (41) or the like is used to trace both the outlines (23) and the internal lines (24) of the xerographic image (20) into the surface of the moistened leather (50); whereupon, the xerographic copy (20) is removed from the leather surface (50) and the initial stage of the method as depicted in FIGS. 1 and 2 is complete.

Figure 3:
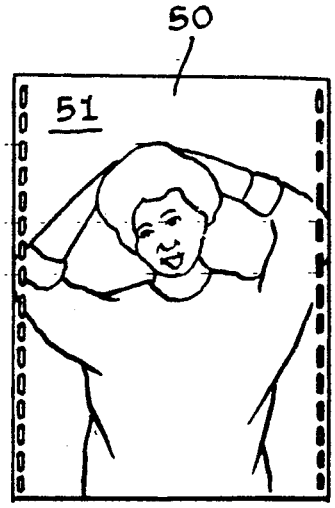
FIG. 3 is a perspective view of the sheet of leather and the equipment employed in the intermediate steps of the method; and, FIG. 4 is a perspective view of the sheet of leather and the equipment employed in the finishing steps of the method.

The intermediate steps of the invention are depicted in FIG. 3 wherein the surface of the leather (50) bears the marks from the tracing step. A first specialized leather working tool (30) such as swivel knife (31) is used to form shallow cuts in the leather surface wherein the cuts coincide with the previously traced lines. Then the leather is remoistened and a second specialized leather working tool (30) such as a diamond head modeler (32) is used to raise selected portions on the surface of the leather (50).

Once the leather (50) has dried, a coat of leather softener (80) is applied to the leather surface by a liquid applicator in the form of a rag (91), or similar article; and, the intermediate steps in this method have been completed.

Figure 4:
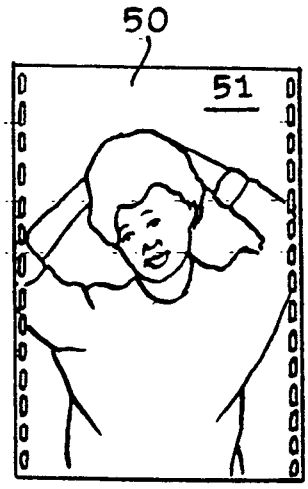
Figure 2A:
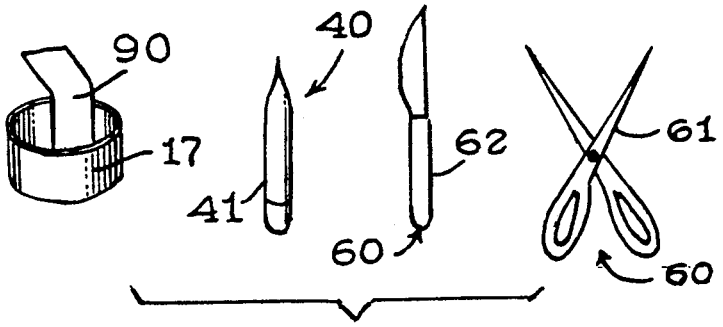
Figure 3A:
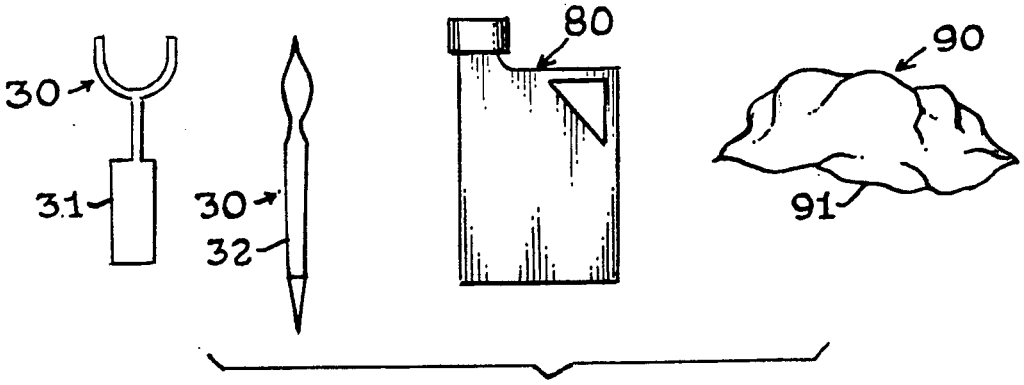
Figure 4A:
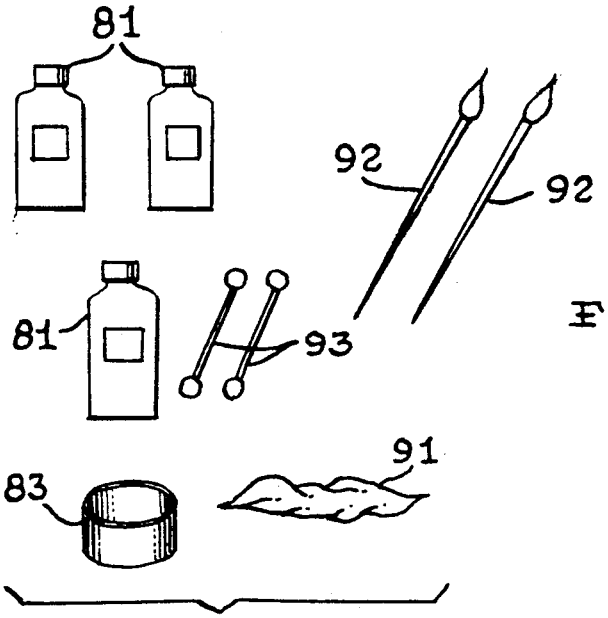

In the final steps of the invention depicted in FIGS. 1 and 4, the photographic image (10) is once again employed to govern the selection of colored leather dyes (81) which are applied to selective areas of the leather surface (50) in accordance to the color scheme of the color photograph (11) by liquid applicators such as brushes (92) and dabbers (93) in a well recognized manner.

Once the dyes (81) have dried, the leather surface (50) is then coated with a leather polish (83) with a liquid applicator such as a rag (91) or the like, and the method of this invention has been completed.

Having thereby described the subject matter of this invention it should be apparent that many substitutions, modifications, and variations of the method steps involved may be made thereto. It is therefore to be understood that the invention as taught and described herein is only to be limited to the extent of the breadth and scope of the appended claims.

I claim:

1. A method of producing a replication of a photographic image on a leather surface involving the steps of:

(a) selecting a photographic image to be replicated on the leather surface;

(b) transferring the photographic image to a xerographic copy;

(c) moistening the surface of the leather;

(d) positioning the xerographic copy on the moistened surface of the leather;

(e) using a tracing implement to impress the outline and selected internal lines of the xerographic image onto the moistened surface of the leather;

(f) using a first specialized leather working tool to produce shallow cuts over the traced lines; and, (g) using a second specialized leather working tool to raise selected portions of the leather surface.

2. The method of claim 1 wherein the xerographic image of step (b) is trimmed of unwanted image portions prior to step (d).

3. The method of claim 1 wherein said first specialized leather working tool comprises a swivel knife.

4. The method of claim 1 wherein said second specialized leather working tool comprises a diamond head modeler.

5. The method as in claim 1 wherein said photographic image comprises a color photograph.

6. The method of claim 5 further comprising the step of:

(i) using liquid applicators to apply colored leather dyes to selected portions of the surface of the leather.

7. The method of claim 6 wherein the colored dyes are chosen to correspond to the color scheme of said color photograph.

8. The method of claim 5 further comprising an intermediate step between steps (g) and step (i) wherein the intermediate step comprises:

(h) applying a leather softener to the surface of the leather.

9. The method as in claim 8 wherein the final step comprises:

(j) applying a coat of leather polish to the surface of the leather.

* * * * *